US006806411B1

(12) United States Patent
Allen

(10) Patent No.: US 6,806,411 B1
(45) Date of Patent: Oct. 19, 2004

(54) MICROTUNER FOR STRINGED MUSICAL INSTRUMENTS

(76) Inventor: Timothy M. Allen, 8024 Indian Bend, San Antonio, TX (US) 78250-3603

( * ) Notice: Subject to any disclaimer, the term of this patent is extended or adjusted under 35 U.S.C. 154(b) by 0 days.

(21) Appl. No.: 10/405,223

(22) Filed: Apr. 3, 2003

(51) Int. Cl.[7] ..... G10G 7/02
(52) U.S. Cl. ..... 84/454; 84/454
(58) Field of Search ..... 84/453, 454, 455, 84/458, 459

(56) References Cited

U.S. PATENT DOCUMENTS

| | | | | | |
|---|---|---|---|---|---|
| 1,577,245 | A | | 3/1926 | Bua | |
| 1,726,849 | A | | 9/1929 | Martyn | |
| 4,006,657 | A | | 2/1977 | Dunnette | 84/314 |
| 4,026,182 | A | | 5/1977 | Gilbrech | 84/305 |
| 4,137,812 | A | | 2/1979 | Franzmann | 84/313 |
| 4,475,432 | A | | 10/1984 | Stroh | 84/314 N |
| 4,549,460 | A | | 10/1985 | Gresset et al. | 84/298 |
| 4,574,678 | A | | 3/1986 | Edwards | 84/314 N |
| D290,017 | S | | 5/1987 | Edwards | D17/20 |
| 4,667,561 | A | | 5/1987 | Storey et al. | 84/314 N |
| 4,669,350 | A | | 6/1987 | Gresset et al. | 84/314 N |
| 4,674,387 | A | | 6/1987 | Caruth | 84/304 |
| 4,677,891 | A | | 7/1987 | Gresset et al. | 84/313 |
| 4,686,883 | A | | 8/1987 | Piche et al. | 84/313 |
| 4,742,750 | A | * | 5/1988 | Storey | 84/313 |
| RE32,863 | E | | 2/1989 | Edwards | 84/314 |
| 4,860,628 | A | * | 8/1989 | Storey | 84/313 |
| 4,878,413 | A | | 11/1989 | Steinberger | 84/314 |
| 4,941,384 | A | | 7/1990 | Jäger | 84/313 |
| 4,945,801 | A | | 8/1990 | Stroh et al. | 84/314 N |
| 5,018,424 | A | | 5/1991 | Steinberger | 84/304 |
| D324,693 | S | | 3/1992 | Rose | D17/21 |
| 5,127,299 | A | | 7/1992 | Stroh et al. | 84/314 N |
| 5,227,095 | A | | 7/1993 | Curtis | 261/30 |
| 5,381,715 | A | | 1/1995 | Spercel | 84/304 |
| D355,433 | S | | 2/1995 | Blanda, Jr. | D17/21 |
| 5,413,019 | A | | 5/1995 | Blanda | 84/298 |
| 5,456,151 | A | | 10/1995 | Enserink | 84/297 |
| 5,460,072 | A | | 10/1995 | Ferdon | 84/313 |
| 5,589,653 | A | | 12/1996 | Rose | 84/314 |
| 5,684,256 | A | | 11/1997 | Rose | 84/314 |
| 5,696,335 | A | | 12/1997 | Rose | 84/298 |
| 5,728,955 | A | | 3/1998 | Sperzel | 84/306 |
| 5,814,745 | A | | 9/1998 | Feiten et al. | 84/312 R |
| 5,932,822 | A | | 8/1999 | Bernstein | 84/314 N |
| 5,955,689 | A | | 9/1999 | Feiten et al. | 84/312 R |
| 5,986,190 | A | * | 11/1999 | Wolff et al. | 84/297 R |
| 6,143,967 | A | | 11/2000 | Smith et al. | 84/313 |
| 6,172,287 | B1 | | 1/2001 | Kang | 84/304 |
| 6,184,450 | B1 | | 2/2001 | LeBlanc | 84/307 |
| D441,006 | S | | 4/2001 | Gregory | D17/21 |
| 6,365,809 | B1 | | 4/2002 | Steinberger | 84/304 |
| 6,426,454 | B1 | | 7/2002 | Gregory | 84/267 |
| 2002/0014144 | A1 | | 2/2002 | Erismann | 84/297 R |
| 2003/0029298 | A1 | | 2/2003 | Feiten et al. | 84/312 R |
| 2003/0110921 | A1 | | 6/2003 | Gregory | 84/312 R |

FOREIGN PATENT DOCUMENTS

| | | | |
|---|---|---|---|
| DE | 4019370 | 1/1991 | G10D/3/14 |
| GB | 2304224 | 3/1997 | G10D/3/00 |

* cited by examiner

*Primary Examiner*—Kimberly Lockett
(74) *Attorney, Agent, or Firm*—Fulbright & Jaworski L.L.P.

(57) ABSTRACT

The invention is a microtuner, for stringed musical instruments with a headstock and individual strings, that includes a roller cam assembly which receives an individual string, and a tuner assembly, which receives the individual string from the roller cam assembly and adjustably presses down onto the individual string. There is also a lever lock string system assembly that pinches down onto the individual string and releasably locks it into position. A clamp or screw assembly secures the microtuner to the headstock. The cam of the microtuner can also be made of a variety of materials to produce an overall sharper sound or an overall softer sound.

6 Claims, 5 Drawing Sheets

MICROTUNER FOR STRINGED MUSICAL INSTRUMENTS

BACKGROUND OF THE INVENTION

1. Field of the Invention

The present invention relates to a microtuner for stringed musical instruments, such as guitars, violins, cellos and other stringed musical instruments.

2. Description of the Related Art

Musical instruments utilize a variety of technologies to produce desired sounds. Stringed instruments utilize concepts involving acoustical physics, audio engineering and even materials science. Many devices reflected in the related art make use of these concepts when used in conjunction with a stringed musical instrument.

U.S. Pat. No. 4,006,657 issued to Dunnette, outlines simple rotational friction pegs in the head of a stringed musical instrument (typically a ukelele), provided with a tension-receiving member for the strings disposed between the instrument nut and the machine head. Each string is looped in a circle about the member, and it is found there is a marked reduction in the tendency for the instrument to detune under the string tension.

U.S. Pat. No. 4,137,812 issued to Franzmann, outlines the use of a device for continuous pitch variation with rotary support levers, which connect an extension piece of the neck flexibly with the body of the instrument. A rotary string holder is mounted on the extension piece of the neck and a ribbon connects the string holder with one of the rotary support levers (via a roller). A tension spring connects one of the rotary support levers with the extension piece of the neck, or as a second possibility, with the body of the instrument.

U.S. Pat. No. 4,878,413 issued to Steinberger, outlines the use of a device for clamping and tuning strings, which extend longitudinally between and past the nut and bridge of a stringed musical instrument. The device includes a base with a plurality of threaded shank elements. A plurality of threaded nuts, are each threaded on a respective shank element. A plurality of actuators are each threaded on a respective threaded shank proximate to a respective threaded nut for selectively applying clamping pressure to a string position between a respective actuation method and threaded nut by rotating to a respective threaded nut and shank element.

U.S. Pat. No. 5,456,151 issued to Enserink, outlines the use of a locking apparatus for a string of a stringed musical instrument, which also includes a tuning mechanism for the string, a locking mechanism, which includes a locking cam arranged rotatably about a point of rotation and a locking wall, with the cam and locking wall positioned relative to each other in such a way that the string can be locked in between them.

U.S. Pat. No. 5,589,653, U.S. Pat. No. 5,684,256 and U.S. Pat. No. 5,696,335 issued to Rose, outlines the use of an improved tuning system, which permits a guitar player to quickly and easily accomplish simultaneous pitch and harmonic tuning of a guitar. The tuning system provides improved strings, which allow for a more rapid and simple replacement of those strings. The tuning system also allows the strings to remain in tune for a significantly longer period of time than other tuning systems found in the prior art.

German Pat. No. DE 4019370 granted to Gunnar, outlines the use of a device for applying tension to a string of a stringed musical instrument, which has an L-shaped lever and which is mounted on a pivot. There is a roller mounted on a spindle at the outer end of the shorter arm of the L-shaped lever and fine adjustment of the string tension provided by a screw, which acts on the longer arm of the L-shaped lever near its outer end. There is also a coarse adjustment provided by a second screw, which acts on the midpoint of the longer arm of the L-shaped lever.

Great Britain Pat. No. 2304224 granted to Woolls, outlines the use of a saddle assembly for a string terminated in a ball end of a stringed musical instrument, which has a saddle body adapted for adjustable mounting on the musical instrument. The saddle body has a bridge over which the string extends and a releasable securing means to secure to the saddle body the ball end of a string passing over the bridge.

Although each of the devices outlined in the preceding patents are novel and useful, what is really needed is a lever lock and micro fine tuner that is easy to install and does not require any modification to the stringed musical instrument being modified. Such a device would be very useful and would be well received in the marketplace.

None of the above inventions and patents, taken either singly or in combination, is seen to describe the instant invention as claimed. Thus a microtuner for stringed musical instruments solving the aforementioned problems is desired.

SUMMARY OF THE INVENTION

The invention is a microtuner for stringed musical instruments with a headstock and individual strings, and includes a roller cam assembly, which receives an individual string, and a tuner assembly, which receives the individual string from the roller cam assembly, and adjustably presses down onto the individual string. There is also a lever lock string system assembly that pinches down onto the individual string and releasably locks it into a single position and a clamp assembly that secures the microtuner to the headstock. The cam of the microtuner can also be made of a variety of materials to produce an overall sharper sound or an overall softer sound.

Accordingly, it is a principal object of the invention to provide a microtuner for stringed musical instruments that is easy to install and does not require modifications to the instrument the microtuner is applied to.

It is another object of the invention to provide a microtuner for stringed musical instruments that utilizes a lever lock and roller cam technology for each individual string on a stringed musical instrument.

It is a further object of the invention to provide a microtuner for stringed musical instruments that can be used with or without a tremelo.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
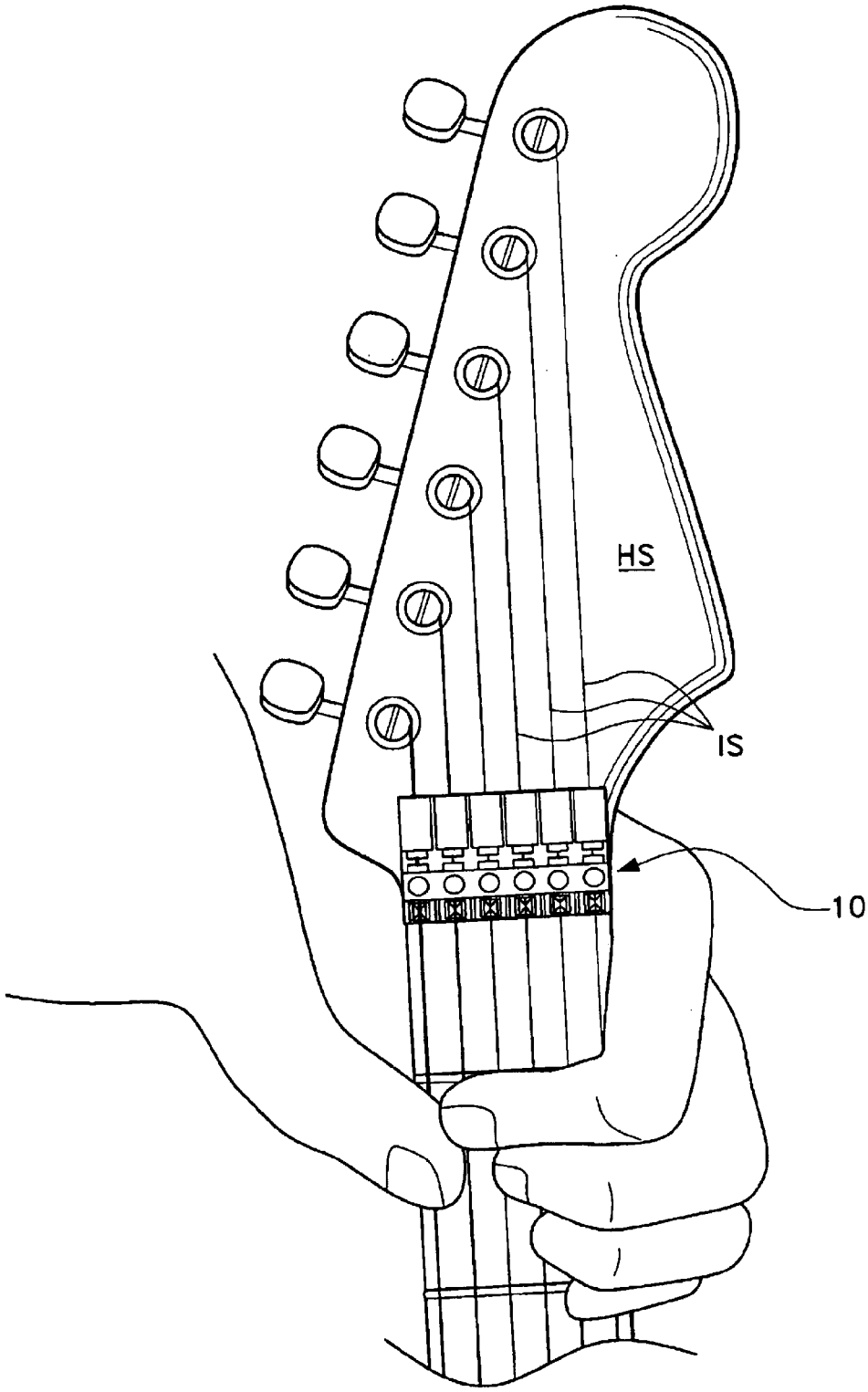
FIG. 1 is an environmental, perspective view of the first embodiment of a microtuner for stringed musical instruments, according to the present invention.
Figure 2:
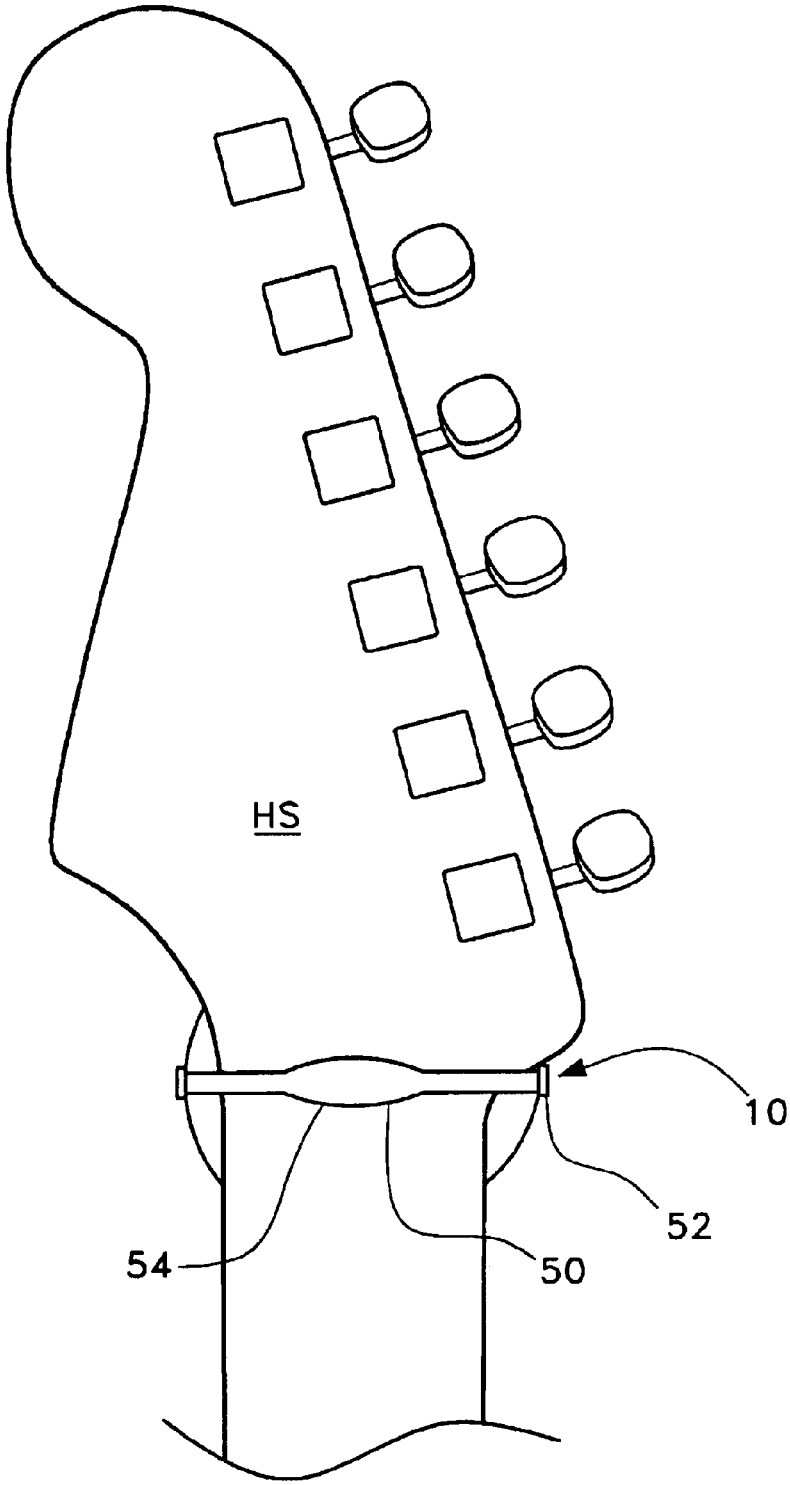
FIG. 2 is a rear perspective view of the microtuner for stringed musical instruments.

The present invention is a microtuner 10 for a stringed musical instrument with a headstock HS and individual strings IS, as are shown in FIG. 1 and FIG. 2.

Figure 3:
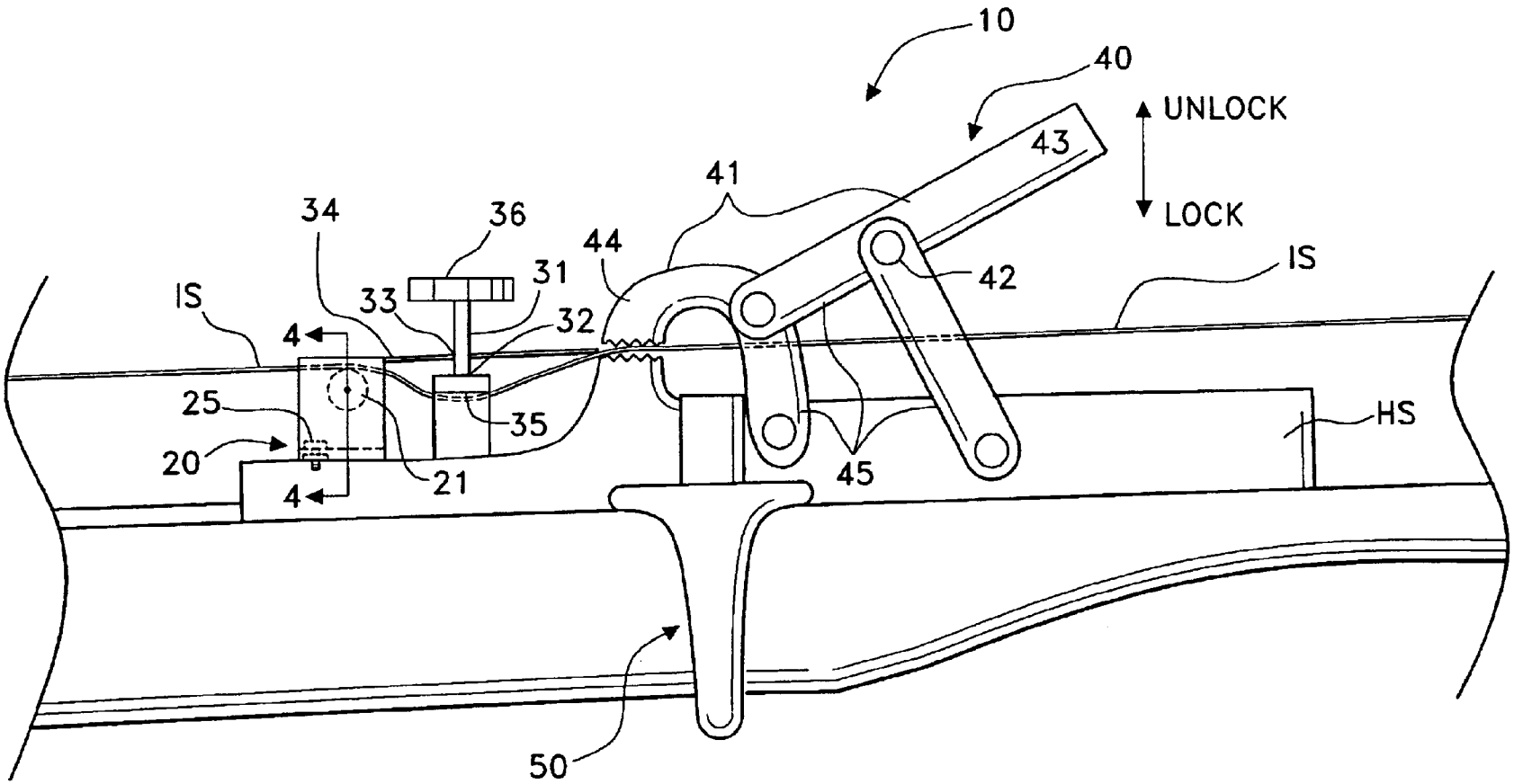
FIG. 3 is a side perspective view of the microtuner for stringed musical instruments.

As shown in FIG. 3, the microtuner 10 comprises a roller cam assembly 20, which receives and saddles an individual string IS, a tuner assembly 30 which receives the individual string IS from the roller cam assembly 20 and adjustably presses down onto the individual string IS, a lever lock string system assembly 40 that pinches down onto the individual string IS and releasably locks it into a single position and a clamp assembly 50 that secures the microtuner 10 to the headstock HS.

As is also depicted in FIG. 3, the microtuner 10 and the tuner assembly 30 include an adjustable screw 31 with a bottom end 32, that threads an aperture 33 on a casing 34 and can be screwed down or screwed up towards the individual string IS below the adjustable screw 31. The adjustable screw 31 has a horizontal shim 35 between the bottom end 32 and the individual string IS. The top of the adjustable screw 36 is knurled for manual tightening or loosening adjustment on the individual string. Note that a single microtuner 10 is designed to be installed on each individual string IS, which are assembled together to form a complete microtuner device.

FIG. 3 also depicts a lever lock string system assembly 40, which is a modified lever 41 and fulcrum 42. The proximal end of the lever 43 can be manually pushed down to lock the lever lock string assembly 40 in a single position that will hold the individual string IS in a downward locked position with the distal end of the lever 44. The proximal end of the lever 43 can also be pulled up to release the individual string IS from a locked position. There is also an assembly of riveted supports 45 for the fulcrum 42 and lever 41 so that the lever lock string assembly 40 can repeatedly be used to lock and unlock an individual string IS.

Referring back to FIG. 2, the back of the microtuner 10 and the clamp assembly 50 has a ball hinge clip 52, that is used to releasably wrap around the headstock HS of the stringed musical instrument. The clamp assembly 50 is also cushioned and flattened 54 to comfortably hold the microtuner 10 in place against the back of the headstock HS of a stringed musical instrument.

Figure 4:
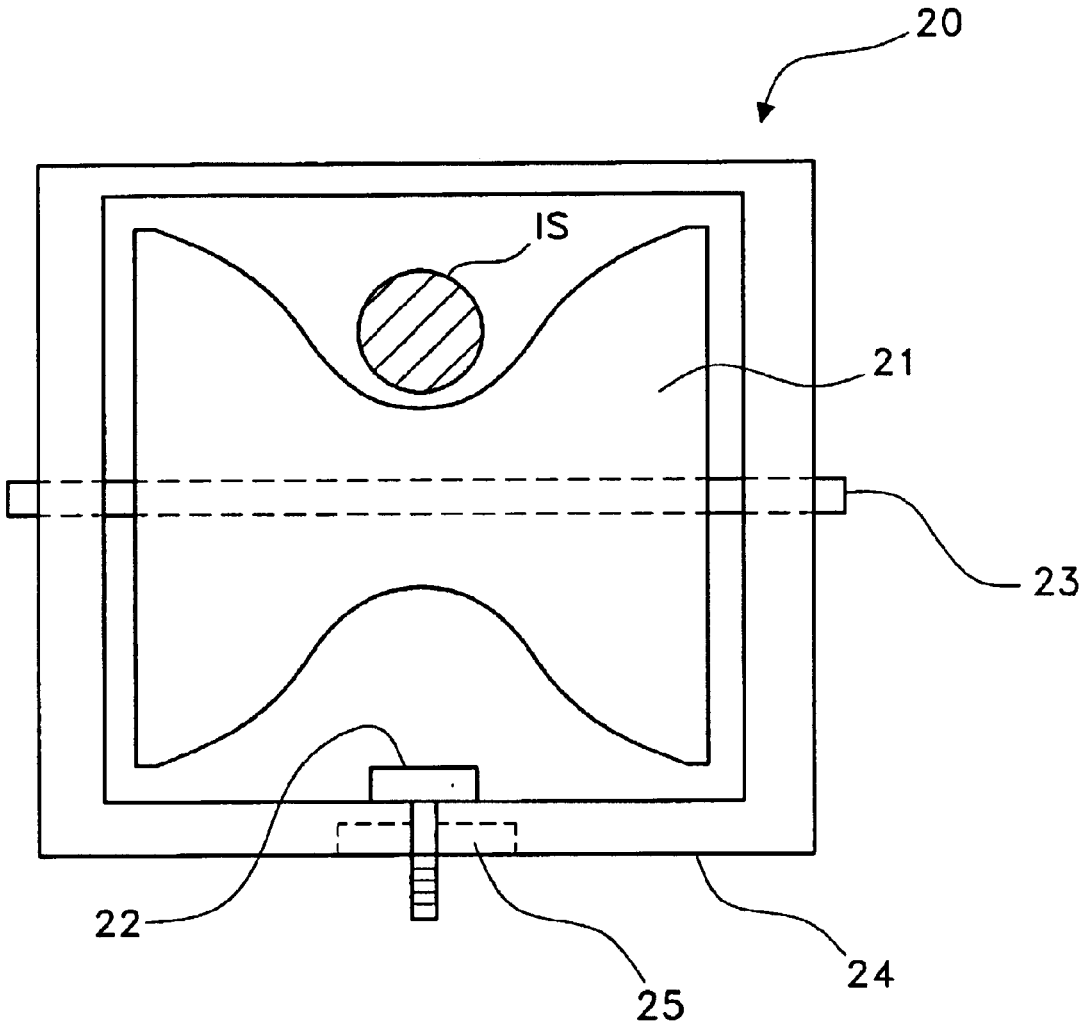
FIG. 4 is a cross-sectional view alone line 4—4 from FIG. 3 of the microtuner for stringed musical instruments.

With reference to FIGS. 3 and 4, the microtuner also includes a roller cam assembly 20, again for each individual string. A roller cam 21 rotates on a removable cam pin or axle 23. This allows the cam to be replaced, or cleaned, or the assembly to be lubricated. The axle is mounted within opposed walls of a cam housing 24 and, in turn, the housing is securely mounted by an allen head screw 22 which is screwed into the device block. Within the base of the housing 24 is a recess for a keeper washer 25. The washer is fixed within its recess so as to hold the screw firmly with respect to the housing, but allows the screw 22 to rotate, to clamp the housing firmly in place. Additionally, however, the screw 22 may be loosened slightly, thus to adjust the housing vertically just a bit, and thus also the cam 21 for even finer adjustment of an individual string. Of course, the screw may be backed all the way out to change the housing and cam. As will be appreciated from FIGS. 3 and 5, the screw axis is offset far enough from its cam so that a small allen wrench (not shown) will have an interference free engagement with the head of the screw 22.

Figure 5:
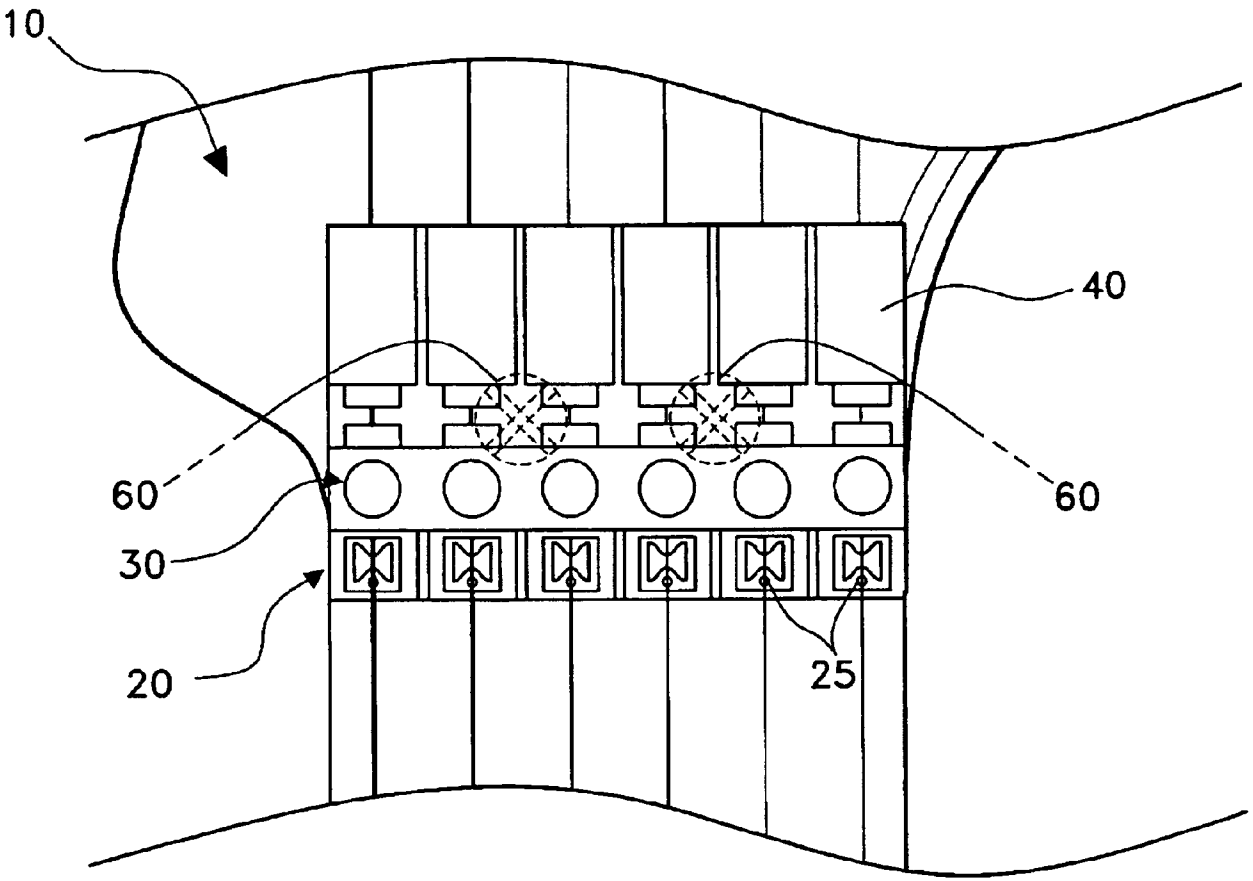
FIG. 5 is an overhead view of the second embodiment of the microtuner for stringed musical instruments.

The microtuner 10 cam 21 can be made of hard metal material, such as steel or brass, to produce a harder and brighter sound. The microtuner 10 cam 21 can also be made of soft nonmetal material, such as plastic or graphite, to produce softer and warmer sounds. The variations of the composition of the cam 21 are points of novelty of the microtuner 10 and are not limited to the composition materials outlined in this application. As is depicted in FIG. 5, the microtuner 10 can also utilize a plurality of wood screws 60 to secure the microtuner 10 to the headstock HS of the stringed musical instrument. This can be a second embodiment of the microtuner 10 for a more permanent installation than the first embodiment of the microtuner 10 using the clamp assembly 50.

Use of the microtuner 10 is straightforward. The microtuner 10 is user installable in minutes by just removing the nut, and clamping assembly 50 in place, restring, tune, lock and play without going out of tune. No matter how the stringed musical instrument is played, either with or without a tremelo (not shown), the microtuner 10 provides a tool less string lock system, microtuning, string height adjustment and roller cam for each individual string IS. The microtuner 10 even provides the ability to break a string and continue playing on a tremelo system, with proper tremelo setup. A cam kit is available to provide different cam 31 arrangements for each individual string IS to make unique and individual sound set-ups, to have more control over the sound from the stringed musical instrument. The added mass of the microtuner 10 to the headstock HS adds more sustain and helps to balance the stringed musical instrument.

It is to be understood that the present invention is not limited to the embodiment described above, but encompasses any and all embodiments within the scope of the following claims.

I claim:

1. A microtuner for a stringed musical instrument with a headstock and individual strings, comprising:

a roller cam assembly which receives an individual string, the roller cam assembly including a cam to receive the individual string, a cam housing to hold the cam, a removable cam pin through the housing for rotatably mounting the cam, and a height adjustment screw to both secure the housing in place and also adjust the height of the individual string by vertically adjusting the position of the housing;

a tuner assembly which receives the individual string from the roller cam assembly and adjustably presses down onto the individual string;

a lever lock string system assembly that pinches down onto the individual string and releasably locks it into a single position; and a clamp assembly that secures the microtuner to the headstock.

2. The microtuner according to claim 1, where the cam is made of hard metal material.

3. The microtuner according to claim 1, where the cam is made of soft nonmetal material.

4. A microtuner for a stringed musical instrument with a headstock and individual strings, comprising:

a roller cam assembly which receives an individual string;

a tuner assembly which receives the individual string from the roller cam assembly and adjustably presses down onto the individual string, the tuner assembly including an adjustable screw with a bottom end that threads an aperture on a casing and can be screwed down or screwed up towards the individual string below the adjustable screw;

a lever lock string system assembly that pinches down onto the individual string and releasably locks it into a single position; and a clamp assembly that secures the microtuner to the headstock.

5. The microtuner according to claim 4, where the adjustable screw has a horizontal shim between the bottom end and the individual string.

6. A microtuner for a stringed musical instrument with a headstock and individual strings, comprising:

a roller cam assembly which receives an individual string;

a tuner assembly which receives the individual string from the roller cam assembly and adjustably presses down onto the individual string;

a lever lock string system assembly that pinches down onto the individual string and releasably locks it into a single position; and a clamp assembly that secures the microtuner to the headstock, the clamp assembly having a ball hinge clip that is used to releasably wrap around the headstock of the stringed musical instrument.

* * * * *